US006854865B2

(12) United States Patent
Probst et al.

(10) Patent No.: US 6,854,865 B2
(45) Date of Patent: Feb. 15, 2005

(54) REFLECTOR FOR LIGHT EMITTING OBJECTS

(75) Inventors: Brian E. Probst, Renovo, PA (US); William T. Storey, Dalmatia, PA (US)

(73) Assignee: W. T. Storey, Inc., Dalmatia, PA (US)

( * ) Notice: Subject to any disclaimer, the term of this patent is extended or adjusted under 35 U.S.C. 154(b) by 120 days.

(21) Appl. No.: 10/365,078

(22) Filed: Feb. 12, 2003

(65) Prior Publication Data

US 2004/0156202 A1 Aug. 12, 2004

(51) Int. Cl.[7] ..... F21V 7/00

(52) U.S. Cl. ..... 362/341; 362/296; 362/347; 362/202

(58) Field of Search ..... 362/296, 341, 362/347, 202

(56) References Cited

U.S. PATENT DOCUMENTS

| | | | | | |
|---|---|---|---|---|---|
| 1,871,629 | A | | 11/1932 | McMenamin | |
| 3,622,776 | A | * | 11/1971 | Wyrick | 362/202 |
| 4,355,350 | A | | 10/1982 | Mader | |
| 4,420,800 | A | | 12/1983 | Van Horn | |
| 4,420,801 | A | | 12/1983 | Reiling et al. | |
| 4,504,889 | A | | 3/1985 | Goldfarb | |
| 4,876,632 | A | | 10/1989 | Osterhout et al. | |
| 5,001,609 | A | * | 3/1991 | Gardner et al. | 362/555 |
| 5,103,381 | A | | 4/1992 | Uke | |
| 5,136,491 | A | | 8/1992 | Kano | |
| 5,235,470 | A | * | 8/1993 | Cheng | 359/852 |
| 5,258,897 | A | | 11/1993 | Nino | |
| 5,406,462 | A | | 4/1995 | Fallahi et al. | |
| 5,459,649 | A | | 10/1995 | Ellion | |
| 5,630,661 | A | | 5/1997 | Fox | |
| 5,682,448 | A | | 10/1997 | Riser | |
| 5,806,962 | A | | 9/1998 | Ellion | |
| 5,871,272 | A | | 2/1999 | Sharrah | |
| 5,894,196 | A | | 4/1999 | McDermott | |
| 5,954,416 | A | | 9/1999 | Peterson | |
| 5,957,567 | A | | 9/1999 | Kish | |
| 6,046,572 | A | | 4/2000 | Matthews | |
| 6,048,084 | A | | 4/2000 | Sedovic et al. | |
| 6,170,960 | B1 | | 1/2001 | Maglica | |
| 6,190,020 | B1 | | 2/2001 | Hartley | |
| 6,193,388 | B1 | * | 2/2001 | Halasz et al. | 362/205 |
| 6,386,730 | B1 | | 5/2002 | Matthews | |
| 6,428,182 | B1 | | 8/2002 | Maglica | |
| 6,485,160 | B1 | | 11/2002 | Sommers | |
| 2003/0063466 | A1 | * | 4/2003 | Kittelmann et al. | 362/296 |

OTHER PUBLICATIONS

Streamlight, Inc. 2003.

* cited by examiner

*Primary Examiner*—Thomas M. Sember
*Assistant Examiner*—Jacob Y. Choi
(74) *Attorney, Agent, or Firm*—Thomas R. Shaffer, Esq.

(57) ABSTRACT

A reflector for flashlights and other light emitting objects is disclosed which includes a generally deep dish shaped reflector member having a reflective inner surface. The reflector member has a rear vertex end and a forward open end and has a depth greater than the average diameter of said forward open end. Preferably the depth is at least 1.2 times greater than said average diameter of the forward open end. Also the reflector preferably has an optical axis and having a focus point located thereon at a location less than 10% of the distance from the rear vertex end to the forward open end of the reflector.

14 Claims, 4 Drawing Sheets

REFLECTOR FOR LIGHT EMITTING OBJECTS

BACKGROUND OF THE INVENTION

1. Field of the Invention.

The present invention relates to a reflector for flashlights and other light emitting objects. More specifically, it relates to a generally deep dish shaped reflector member having a depth greater than the average diameter of a forward open end thereof for providing an efficient focused beam of light.

2. Description of the Prior Art

A variety of reflectors have been proposed for flashlights and other light emitting objects.

Matthews, U.S. Pat. No. 6,386,730, discloses a flashlight having a head with two merged yet independent lamp/reflector systems. While Matthews teaches the provision of two reflectors, both reflectors are simply used to independently focus light from two light sources into the forwardly directed beam configurations.

McDermott, U.S. Pat. No. 5,894,196, discloses a compact lighting device including a light concentrating reflector directing light emitted by a light source toward a curved light refracting surface where it is refracted and thereby redirected. McDermott teaches the generation of substantially elliptical patterns of light.

Sharrah et al., U.S. Pat. No. 5,871,272, discloses a flashlight having a lamp head including a reflector having a major paraboloid reflective surface and a minor reflective paraboloid surface not interacting on the same light source.

Matthews et al., U.S. Pat. No. 6,046,572, discloses a flashlight having a flashlight beam is cast with a first lamp and reflector and an alternative second lamp and reflector assembly is substituted for the first lamp and reflector to provide a different configuration of beam illumination.

Goldfarb, U.S. Pat. No. 4,504,889, discloses a flashlight having a generally parabolic reflector and a beam-narrowing lens.

Uke, U.S. Pat. No. 5,103,381, discloses a lamp reflector of at least partially parabolic shape with a light source mounted at the focus. A lens is mounted between the light source and the open forward end a collimating pillar of transparent material is disclosed as extending inwardly from the center of the open end toward the lens.

Ellion, U.S. Pat. No. 5,459,649, discloses a flashlight with an enhanced spot beam and fully illuminated broad beam. A modified parabolic reflector is disclosed.

Fox, U.S. Pat. No. 5,630,661, discloses a metal arc flashlight. An elliptical reflector focus emitted light onto a diffusion screen and a movable collimating lens is disposed in front of the screen making the beam adjustable.

Ellion, U.S. Pat. No. 5,806,962, discloses a flashlight reflector which allegedly produces no bright and dull rings by utilizing more precise manufacturing tolerances.

Sedovic et al., U.S. Pat. No. 6,048,084, discloses a reflector for a flashlight having a pair of opposing walls forming a rectangular opening of area projection.

Peterson, U.S. Pat. No. 5,954,416, discloses a flashlight which utilizes a rotating reflector to eliminate a dark center ring which results if a light source is moved away from the focal point of a parabolically shaped reflector.

Hartley, U.S. Pat. No. 6,190,020, discloses a flashlight utilizing a light emitting diode light source with light dispersed away from a central axis. A collimating reflector is then utilized to produce a beam of light. Various diffusion methods are described.

Kish, et al, U.S. Pat. No. 5,957,567, discloses a flashlight which has a reflector which is axially movable with respect to the bulb to afford adjustable focusing of the light emitted from the bulb. The reflector also utilizes a facetted parabolic surface on a portion of the reflector.

Maglica, U.S. Pat. No. 6,170,960, discloses a miniature flashlight including a parabolic reflector such that rotation of the head relative to the barrel of the flashlight changes the focus of the flashlight beam.

Maglica, U.S. Pat. No. 6,428,182, discloses flashlight having a reflector and switch housing. The switch housing partially floats within the flashlight tube to allow for slight adjustment of the lamp relative to the reflector to insure centering of the lamp.

Sommers et al., U.S. Pat. No. 6,485,160, discloses a flashlight which utilizes a semiconductor light source a reflector and a lens to focus the light. In one embodiment three light sources with three reflectors and three lens are utilized to direct light toward a target area.

Osterhout et al., U.S. Pat. No. 4,876,632 discloses a flashlight which utilizes a LED light source and a parabolic reflector 30 (FIG. 2).

There remains a need for a reflector for flashlights and other light emitting objects which efficiently focus the light into a bright tightly focused beam.

SUMMARY OF THE INVENTION

The present invention provides a reflector for flashlights and other light emitting objects comprising a generally deep dish shaped reflector member having a reflective inner surface, said reflector member having a rear vertex end and a forward open end and having a depth greater than the average diameter of said forward open end.

Preferably the depth is at least 1.2 times greater than said average diameter of said forward open end.

Preferably the depth is at least 1.7 times greater than said average diameter of said forward open end.

Preferably the depth is at least 2.0 times greater than said average diameter of said forward open end.

The reflector preferably includes an optical axis and having a focus point located on said optical axis at a location less than 10% of the distance from the rear vertex end to the forward open end of said forward open end.

Preferably, the focus point is located on said optical axis at a location less than 5% of the distance from the rear vertex end to the forward open end of said forward open end.

Preferably, the focus point located on said optical axis at a location approximately 2% of the distance from the rear vertex end to the forward open end.

In one preferred embodiment, the focus point located on said optical axis at a location approximately 0.06 inches away from said vertex end.

Preferably, the reflector for flashlights and other light emitting objects has a light emitting element, said light emitting element having a light emitting surface, said reflector comprising a generally deep dish shaped reflector member having a reflective inner surface and having a rear vertex end and a forward open end, said reflector member having at least one cross sectional configuration in the form of a parabola formed according to the formula $x^2=(4)(f)(y)$ where x and y represent points on a Cartesian coordinate system and f is the distance of the focal point from the vertex of the parabola along an optical axis, said optical axis located along a line where x=0, and said vertex located at the point where x=0 and y=0, said reflector member having a circular opening formed at a forward end thereof at the location of a plane of truncation, said circular opening having a diameter D and said circular opening having a center point located on said optical axis, said plane of truncation intersecting said optical axis at a 90 degree angle and at a distance T from said vertex thus creating a reflector with a depth T, said light emitting surface having a center point located at the focal point of the reflector and wherein the ratio of the depth of the reflector T to said diameter of the reflector D to is at least 1.2, said focal point being located on said optical axis close to said vertex at a location less than 10% of the distance from the vertex to said plane of truncation.

Preferably, said ratio of the depth of the reflector T to said diameter of the reflector D to is at least 1.4.

Preferably, said ratio of the depth of the reflector T to said diameter of the reflector D to is at least 1.7.

Preferably, said ratio of the depth of the reflector T to said diameter of the reflector D to is at least 2.0.

Preferably, said ratio of the depth of the reflector T to said diameter of the reflector D to is at least 4.0.

Preferably, said focal point is located on said optical axis at a location less than 5% of the distance from the vertex to said plane of truncation.

Preferably, said focal point is located on said optical axis at a location approximately 2% of the distance from the vertex to said plane of truncation.

Preferably, said depth T is approximately 3 inches and said diameter D is approximately 1.7 inches.

Preferably, said focal point is located at a distance of approximately 0.06 inches away from said vertex.

Preferably, a center point of said light emitting surface is located at a point on said optical axis as close to the vertex as possible but at a location just far enough away from said vertex such that the entire light emitting surface is completely positioned within said reflector member whereby light emitted in a radially outward direction by said light emitting surface is reflected forwardly by said reflector member.

Preferably, light emitting surface is generally circular in shape but may be any shape.

Preferably, said reflector member has a cross sectional configuration in the form of a parabola in all planes which include the line x=0.

Preferably, said light emitting element emits light in forward or sideways directions but not in a rearward direction.

Preferably, said light emitting element is a light emitting diode.

It is contemplated that the reflector of the present invention may be utilized for a variety of light emitting objects including, but not limited to, flashlights, task lights, head lights for automobiles, track lights, spot lights and various head lamps for individuals such as miners, dentists and doctors, for example, and for various optical instruments such as transits, collimators and the like.

DETAILED DESCRIPTION OF THE PREFERRED EMBODIMENTS

Figure 1:
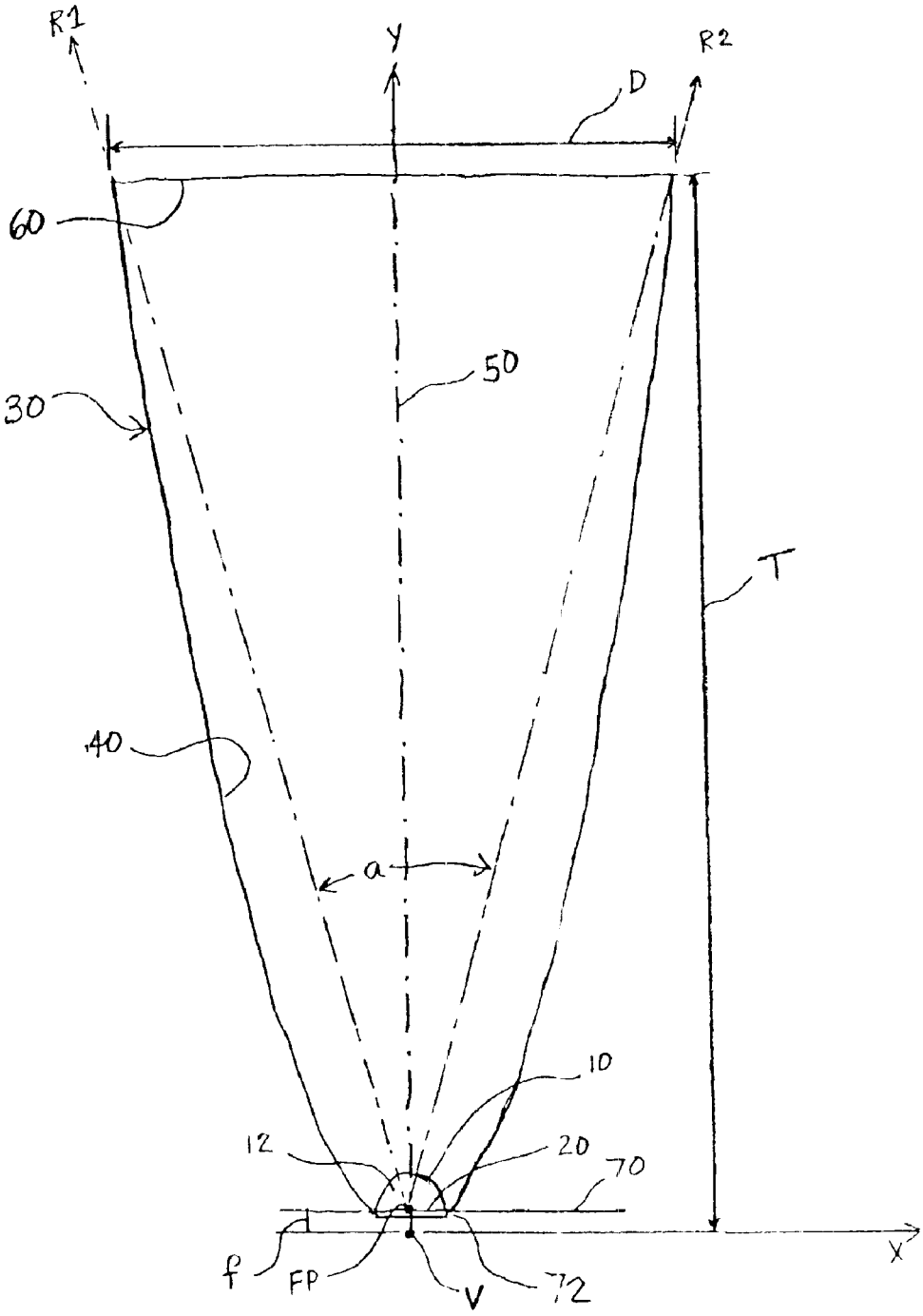
FIG. 1 is a cross sectional view showing the inner surface of the reflector of the present invention.

Referring to FIG. 1, the reflector 30 of the present invention is formed in a configuration of a parabola and has a highly reflective inner surface 40. The vertex V of the parabola is located at the points on a Cartesian coordinate system where X equals 0 and Y equals 0. The focal point FP of the reflector 30 is located along an optical axis 50 and is located at a distance f from the vertex. As shown, the reflector has a diameter D and a depth of T. The end opposite the vertex terminates along a plane of truncation 60 which forms an open end.

A light source, in the form of a light emitting diode 10 having a lens 12 and having a light emitting surface 20 is provided such that the center of the light emitting surface 20 is located at the focal point FP as shown. The reflective inner surface 40 is truncated at the vertex end along plane 70 which is co-planer with the light emitting surface 20. This forms an opening 72 near the vertex which is just large enough for the entire light emitting surface 20 to be contained completely within the inner surface 40 of the reflector 30.

The deep dish or long parabolic reflector has been developed in order to maximize the light output from an LED light source or other light emitting object. Applicants have discovered that the ratio between the depth of the parabolic surface T and the diameter D makes the reflector superior to known devices where a concentrated beam of light is desired.

Applicants have discovered that it is desirable to place the LED light source as close as possible to the vertex V thereby keeping the focal length f as short as possible. This principal is explained more fully in FIGS. 2 and 3.

Figure 2:
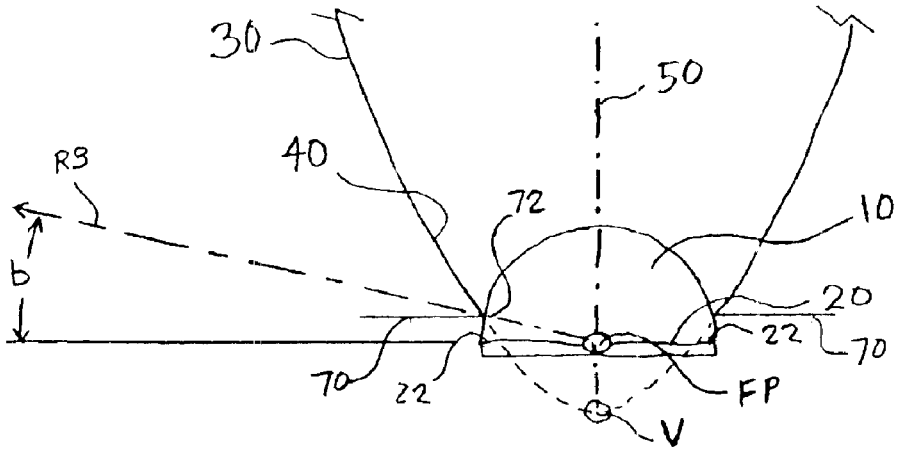
FIG. 2 is a cross sectional view showing a portion of the inner surface of the reflector of the present invention with an LED light source positioned too deeply in the reflector.

In FIG. 2, an LED light source 10 having a light emitting surface 20 is placed too deep within the inner reflective surface 40 of reflector 30 such that outer portions 22 of the light emitting surface 20 actually extend outside of the parabolic reflector. Because of this, a portion of the light generated by the light emitting surface 22 which is emitted radiantly is not reflected by the inner surface 40 but rather as, is shown by ray of light R3, is not captured by the reflective surface 40. Because of this, all rays of light within an angle "b" are not captured and thus a substantial portion of the light emitted by the light emitting surface 22 is essentially wasted. In FIG. 2 the focal point FP is closer to the vertex V than is shown in FIG. 3.

Figure 3:
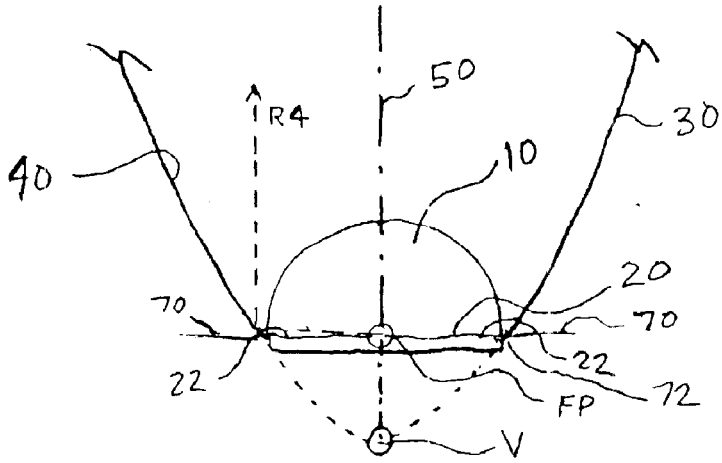
FIG. 3 is a cross sectional view showing a portion of the inner surface of the reflector showing an LED light source properly positioned within the reflector.
Figure 4:
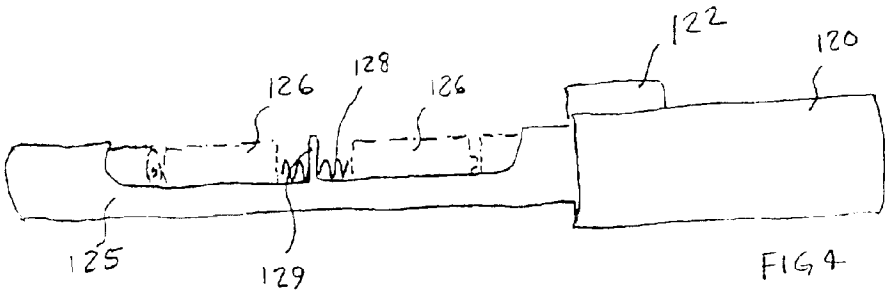
FIG. 4 shows the head portion and battery carriage for a flashlight formed according to the present invention.

In FIG. 3, the light emitting surface 20 is placed entirely within the reflective surface 40 of reflector 30. In this preferred embodiment, outer edge portions 22 of the light emitting surface 20 are fully within the reflective surface.

Thus, all rays of light, such as ray R4 which are emitted radially outward, are reflected parallel to the optical axis 50 as shown. In this case, the opening 72 along the plane of truncation 70 is co-planer with the light emitting surface 20. In FIG. 2, the plane of truncation 70 at the vertex end is not co-planer but rather is higher than the plane of the light emitting surface 22.

Referring back to FIG. 1, it will be seen that a certain portion of the light from the LED 10 will pass without being reflected by the reflector 30 directly out of the front open end of the reflector 30 through the plane of truncation 60 as is shown by rays of light R1 and R2. The angle between these two rays is an angle "a" which angle becomes smaller and smaller the deeper the reflector becomes.

The general formula for a parabola is $x^2=(4)(f)(y)$ where f=focus of the parabola. When x is known, y can be calculated by the formula $y=x^2/(4)(f)$.

In the preferred embodiment of the invention, as shown in FIG. 1 a focus f of 0.06" is utilized. Using the above formula, the following chart shows what the depth, the diameter and the depth to diameter ratio is for various depths of the reflector.

| Depth | Diameter | Depth to Diameter Ratio |
|---|---|---|
| | (all numbers are in inches) | |
| 1.0416 | 1.000 | 1.0416 |
| 1.5000 | 1.200 | 1.2500 |
| 2.0000 | 1.386 | 1.443 |
| 3.0000 | 1.697 | 1.767 |
| 4.1667 | 2.000 | 2.08335 |
| 16.667 | 4.000 | 4.16675 |
| 37.500 | 6.000 | 6.25 |

From the foregoing, it can be seen that as the diameter of the plane of truncation increases, the depth of the reflector begins to increase exponentially. Applicants prefer the depth to diameter ratio to be as large as possible but, as can be seen from the above chart, the depth quickly becomes unmanageable for a flashlight as it is unlikely that one would want to carry a flashlight having a reflector over 37" deep.

In the presently preferred embodiment of the invention, a flashlight is produced as shown in FIGS. 4, 5, 6 and 7 which has a reflective surface 240 which has a diameter of 1.697" and a depth of 3.00". As shown in these figures, the flashlight has an unusual visual appearance as most flashlights have been designed upon a principal of keeping the depth of the reflector relatively short so as not to unnecessarily take up space which could be otherwise be used for batteries and the like. Applicants, on the other hand, have found that utilizing the deep dish reflector provides an extremely efficient and bright beam of concentrated light which is superior to the beams of light generated by shallower reflectors or reflectors which place an LED or other light source at a focal point at a distance further away from the vertex than is absolutely necessary.

Referring again to FIG. 2, although such an embodiment of the invention is not preferred as it results in an unnecessary loss of light, when the LED is placed closer to the vertex V, the angle "a" decreases. Thus, for example, the angle "a" as shown in FIG. 1 might be 32.198° whereas the corresponding angle "a" if the LED were moved downwardly as shown in FIG. 2 might decrease to an angle of 26.435°. Having a narrower angle of dispersion may be desirable in certain cases even with the knowledge that some of the illumination is being wasted. Thus, while not preferred, the present invention still recognizes the utility of the embodiment shown in FIG. 2. In the example shown in FIG. 2, angle "b" would be an angle of 13.774° which would result in a substantial loss of total illumination.

Referring briefly to the flashlight shown in FIGS. 4–7, a head 120 is provided which includes a switch 122 and a battery carrier 125 adapted to receive batteries 126 which are held in place by springs 128. A divider 129 in the battery carrier is utilized to provide two different banks of cells which can be utilized to illuminate the LED 210 (FIG. 7) independently of one another.

Figure 5:
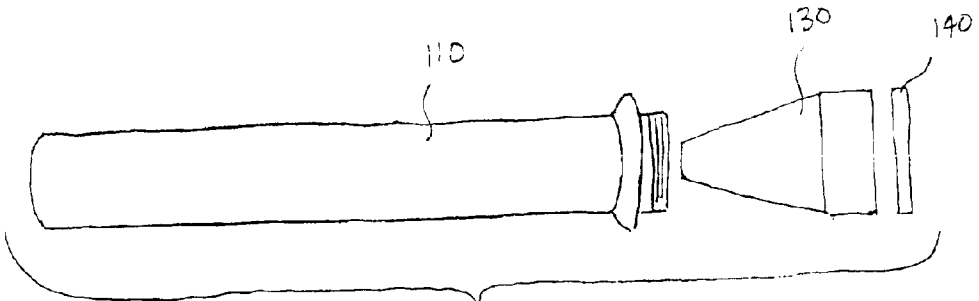
FIG. 5 shows the body portion, reflector and front lens of the flashlight of FIG. 4.

Referring to FIG. 5, a body 110 is shown which screws into head portion 120. A reflector 130 is provided as is a front lens 140. It will be obvious that depending upon the nature of the inner surface of the reflector 130 that lens 140 would be optional.

Figure 6:
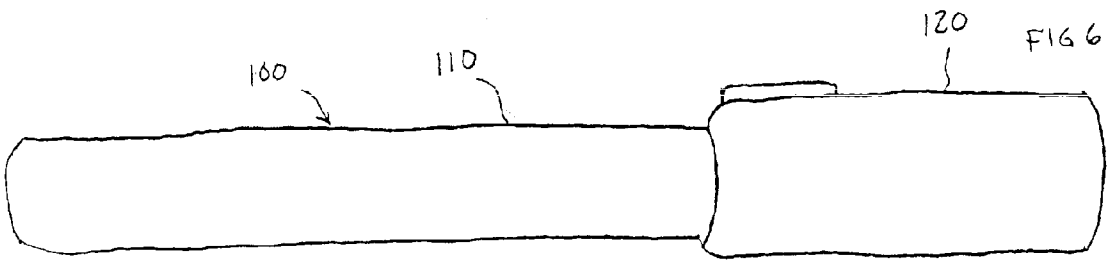
FIG. 6 is a side view of the flashlight of FIGS. 4 and 5 as assembled.

FIG. 6 shows the flashlight 100 with the head portion 120 attached to the body portion 110.

Figure 7:
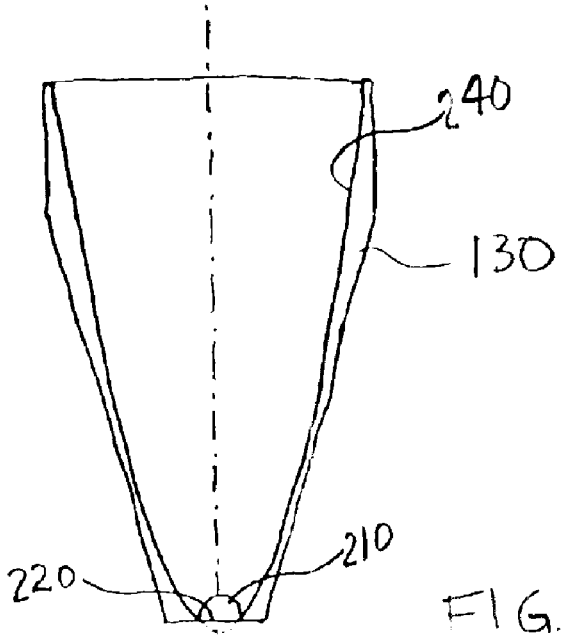
FIG. 7 is a cross sectional view of the reflector of the flashlight shown in FIG. 5.

FIG. 7 shows a cross sectional view of the reflector 130 showing an inner reflective surface 240, a light emitting diode 210 having a light emitting surface 220 fully contained within the reflective surface 240.

Figure 8:
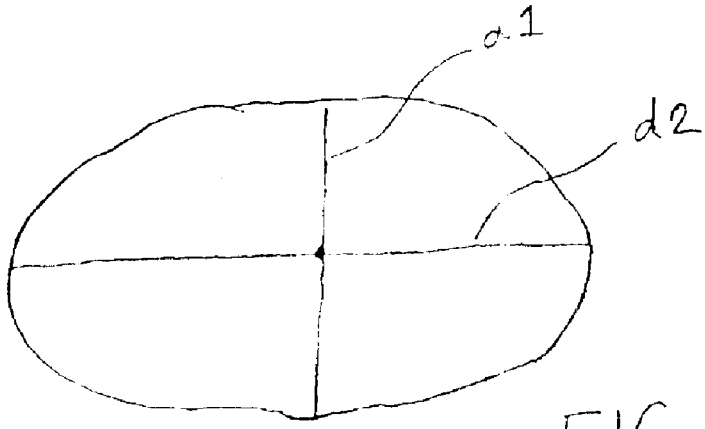
FIG. 8 is a cross sectional view along a plane of truncation showing a reflector having an oval rather than circular configuration.

FIG. 8 shows a plane of truncation of an alternate embodiment of the present invention which has a front opening which is not circular but oval. It will be understood by those skilled in the art that various shapes of the opening end could result in a variety of three dimensional shapes to create non-circular beamed shapes. As shown in FIG. 8, a first diameter d1 and a second diameter d2 are shown. The present invention contemplates a generally deep dish shaped reflector member having a reflective inner surface and having a reflector having a rear vertex and a forward open end and having a depth greater than the average diameter of the forward open end. Thus, an average would be taken of D1 and D2 to calculate the average diameter of the forward open end of the reflector of FIG. 8.

While we have shown and described the presently preferred embodiment of our invention, the invention is not limited thereto and may be otherwise variously practiced within the scope of the following claims:

What is claimed is:

1. A reflector for flashlights and other light emitting objects having a light emitting element, said light emitting element having a light emitting surface, said reflector comprising a generally deep dish shaped reflector member having a reflective inner surface and having a rear vertex end and a forward open end, said reflector member having at least one cross sectional configuration in the form of a parabola formed according to the formula $x^2=(4)(f)(y)$ where x and y represent points on a Cartesian coordinate system and f is the distance of the focal point from the vertex of the parabola along an optical axis, said optical axis located along a line where x=0, and said vertex located at the point where x=0 and y=0, said reflector member having a circular opening formed at a forward end thereof at the location of a plane of truncation, said circular opening having a diameter D and said circular opening having a center point located on said optical axis, said plane of truncation intersecting said optical axis at a 90 degree angle and at a distance T from said vertex thus creating a reflector with a depth T, said light emitting surface having a center point located at the focal point of the reflector and wherein the ratio of the depth of the reflector T to said diameter of the reflector D is at least 1.2, said focal point being located on said optical axis close to said vertex at a location less than 10% of the distance from the vertex to said plane of truncation.

2. A reflector according to claim 1 wherein said ratio of the depth of the reflector T to said diameter of the reflector D is at least 1.4.

3. A reflector according to claim 1 wherein said ratio of the depth of the reflector T to said diameter of the reflector D is at last 1.7.

4. A reflector according to claim 1 wherein said ratio of the depth of the reflector T to said diameter of the reflector D is at last 2.0.

5. A reflector according to claim 1 wherein said ratio of the depth of the reflector T to said diameter of the reflector D is at last 4.0.

6. A reflector according to claim 1 wherein said focal point is located on said optical axis at a location less than 5% of the distance from the vertex to said plane of truncation.

7. A reflector according to claim 1 wherein said focal point is located on said optical axis at a location approximately 2% of the distance from the vertex to said plane of truncation.

8. A reflector according to claim 1 wherein said depth T is approximately 3 inches ad said diameter D is approximately 1.7 inches.

9. A reflector according to claim 8 wherein said focal point is located at a distance of approximately 0.06 inches away from said vertex.

10. A reflector according to claim 1 wherein the center point of said light emitting surface is located at a point on said optical axis as close to the vertex as possible but at a location just far enough away from said vertex such that the entire light emitting surface is completely positioned within said reflector member whereby light emitted in a radially outward direction by said light emitting surface is reflected forwardly by said reflector member.

11. A reflector according to claim 1 wherein said light emitting surface is generally circular in shape.

12. A reflector according to claim 1 wherein said reflector member has a cross sectional configuration in the form of a parabola in all planes which include the line x=0.

13. A reflector according to claim 1 wherein said light emitting element emits light in forward or sideways directions but not in a rearward direction.

14. A reflector according to claim 1 wherein said light emitting element is a light emitting diode.

* * * * *

UNITED STATES PATENT AND TRADEMARK OFFICE

CERTIFICATE OF CORRECTION

PATENT NO. : 6,854,865 B2
DATED : February 15, 2005
INVENTOR(S) : Probst et al.

It is certified that error appears in the above-identified patent and that said Letters Patent is hereby corrected as shown below:

Title page,
Item [57], ABSTRACT,
Line 8, “having” should read -- has --

Column 1,
Line 34, “having” should read -- wherein --
Line 44, “a” should read -- A --
Line 51, “focus” should read -- focuses --

Column 2,
Line 12, insert -- a -- after “discloses”
Line 18, insert -- , -- after “source”
Line 21, “three lens” should read -- three lenses --
Line 24, “utilizes a” should read -- utilizes an --
Line 27, “focus” should read -- focuses --
Line 46, delete “the” after “end to”
Line 47, delete “forward open end of” before “said”
Line 51, delete “the forward open end of” after “to”
Line 52, insert -- is -- after “focus point”
Line 55, insert -- is -- after “point”

Column 3,
Lines 13, 18, 20, 22 and 24, delete “to” after “reflector D”
Line 43, insert -- the -- after “Preferably,”
Line 49, “directions” should read -- direction --

Column 4,
Line 57, “radiantly” should read -- radially --

Column 5,
Line 18, delete “as shown in” after “invention,”
Line 19, delete “FIG. 1” before “a focus”

Column 6,
Line 38, “D1 and D2” should read -- d1 and d2 --
Line 44, “What claimed is:” should read -- We claim: --

UNITED STATES PATENT AND TRADEMARK OFFICE

CERTIFICATE OF CORRECTION

PATENT NO. : 6,854,865 B2
DATED : February 15, 2005
INVENTOR(S) : Probst et al.

It is certified that error appears in the above-identified patent and that said Letters Patent is hereby corrected as shown below:

Column 7,
Line 24, "ad" should read -- and --

Signed and Sealed this

Twenty-fourth Day of May, 2005

JON W. DUDAS
*Director of the United States Patent and Trademark Office*